US005404215A

United States Patent [19]

Bares

[11] Patent Number: 5,404,215

[45] Date of Patent: Apr. 4, 1995

[54] DEVELOPED BEAD PICK-OFF DEVICE

[75] Inventor: Jan Bares, Webster, N.Y.

[73] Assignee: Xerox Corporation, Stamford, Conn.

[21] Appl. No.: 978,008

[22] Filed: Nov. 18, 1992

[51] Int. Cl.[6] ..... G03G 21/00

[52] U.S. Cl. ..... 355/296; 118/652; 355/215; 355/305

[58] Field of Search ..... 355/296, 297, 305, 253, 355/306, 215, 245, 251, 269, 270, 298; 118/652, 653, 657

[56] References Cited

U.S. PATENT DOCUMENTS

| | | | |
|---|---|---|---|
| 3,834,804 | 9/1974 | Bhagat et al. | 355/306 |
| 3,920,329 | 11/1975 | Dennie et al. | 355/297 |
| 3,951,542 | 4/1976 | Ito et al. | 355/298 |
| 4,101,211 | 7/1978 | Kayson | 118/653 X |
| 4,139,296 | 2/1979 | Ruckdeschel | 118/657 X |
| 4,389,968 | 6/1983 | Satomura | 118/652 |
| 4,530,597 | 7/1985 | Itaya et al. | 355/305 X |
| 4,829,338 | 5/1989 | Whittaker et al. | 355/305 |
| 4,839,688 | 6/1989 | Bares | 355/253 |
| 4,928,149 | 5/1990 | Harmon | 355/296 |
| 5,047,807 | 9/1991 | Kalyandurg | 355/296 X |
| 5,081,503 | 1/1992 | Parker et al. | 355/296 |
| 5,138,382 | 8/1992 | Van Duser et al. | 355/305 X |
| 5,184,194 | 2/1993 | Mosehauer et al. | 355/296 X |

FOREIGN PATENT DOCUMENTS

| | | | |
|---|---|---|---|
| 57-13470 | 1/1982 | Japan | 355/305 |
| 57-24972 | 2/1982 | Japan | 355/305 |
| 57-70579 | 5/1982 | Japan | 355/305 |
| 60-119592 | 6/1985 | Japan | 355/305 |

*Primary Examiner*—Matthew S. Smith
*Assistant Examiner*—Shuk Y. Lee
*Attorney, Agent, or Firm*—Finnegan, Henderson, Farabow, Garrett & Dunner

[57] ABSTRACT

To remove ferromagnetic carrier beads from the surface of a photoreceptor leaving a development station in an electrophotographic machine, the carrier beads are magnetically attracted to the surfaced of an elongated, rotating cylinder. The cylinder surface is provided with a raised spiral thread to create a material conveying auger operating to axially convey the attracted beads to a cylinder end portion beyond a side edge of the photoreceptor, where the carrier beads fall into a sump.

13 Claims, 3 Drawing Sheets

DEVELOPED BEAD PICK-OFF DEVICE

The present invention relates to electrophotographic printing or copying machines, and particularly to an improved pick-off device for removing developer beads which can remain attracted to the surface of a photoreceptor after leaving latent electrostatic image development apparatus included in such machines.

BACKGROUND OF THE INVENTION

In electrophotographic copying machines, the moving surface of a photoreceptor is charged to a substantially uniform potential during passage through a charging station, and then, during passage through an imaging station, the charged photoreceptor surface is exposed to a light image of an original document to be copied. The light image selectively discharges the photoreceptor surface to produce a latent electrostatic image replicating the original document. This latent image is then translated through a development station where it is developed by contacting the photoreceptor surface with developer powder or toner to create a powder image conforming to the latent electrostatic image. The powder image moves with the photoreceptor to a transfer station where it is transferred or offset printed onto a copy sheet. The transferred powder image is fused to the copy sheet surface, thereby creating a permanent copy of the original document. The photoreceptor then returns to the charging station through a cleaning station where residual toner is removed from the photoreceptor surface.

In the case where the development station apparatus uses a two-component developer material to develop the latent electrostatic image into a powder image, fine toner particles or powder are made to adhere to the surfaces of coarse, ferromagnetic carrier granules or beads by triboelectric attraction. This two-component developer is brought into contact with the photoreceptor surface by suitable means, such as a magnetic brush forming roller, to transfer toner from the carrier beads to the latent electrostatic image, thereby creating the conforming powder image. Unfortunately, some of the carrier beads may also be attracted to the photoreceptor surface and are held there with the powder image upon exiting the development station. This phenomenon, known as "bead carryout" can be a persistent problem in electrophotographic copiers. In the transfer station, these spurious, adhering carrier beads prevent localized intimate contact between the copy sheet surface and the toner particles of the powder image, thereby causing copy deletions that degrade copy quality. Moreover, if these spurious carrier beads remain attracted to the photoreceptor surface as it goes through the cleaning station, they can abrade the photoreceptor surface as they are mechanically removed by a rotating cleaning brush. It is therefore highly desirable that all such spurious carrier beads leaving the development station on the photoreceptor surface be removed prior to arrival at the transfer station. It is also desirable that the removal of these carrier beads from the photoreceptor surface be achieved without disturbing the powder image.

Another important consideration is that a carrier bead pick-off device structured to achieve these desired objectives be as compact as possible, since available space within the confines of an electrophotographic copier is typically at a premium.

SUMMARY OF THE INVENTION

The present invention was made in view of the above circumstances and has as an object to provide an improved pick-off device for removing developer or carrier beads spuriously attracted to the surface of a photoreceptor in an electrophotographic copier.

An additional object is to provide a bead pick-off device of the above character, wherein disposal of carrier beads removed from the photoreceptor surface is effected in an efficient and effective manner.

A further object is to provide a bead pick-off device of the above character, which is simple and compact in construction, inexpensive to manufacture, and convenient to implement and service.

Additional objectives and advantages of the present invention will be set forth in part in the description which follows and in part will become apparent from the following description or learned through practice of the present invention.

The objects and advantages of the invention may be realized and attained by means of the instrumentalities and combinations particularly pointed out in the appendant claims. To achieve these objectives, the bead pick-off device of the present invention includes an elongated cylinder which is positioned closely adjacent the surface of a photoreceptor in an electrophotographic copier and oriented transversely to the motional direction of the photoreceptor surface. A stationary, elongated magnet is positioned within the cylinder to develop a magnetic field concentrated in a pick-off region generally between the moving photoreceptor surface and the cylinder. This magnetic field attracts ferromagnetic carrier beads from the photoreceptor surface to the smooth exterior surface of the cylinder.

In accordance with a principal feature of the present invention, the exterior surface of the cylinder is configured to provide a material conveying auger. Thus, upon rotation of the cylinder, beads picked from the photoreceptor surface and held against the cylinder surface by the magnetic field, are caused to slip over the smooth cylinder exterior surface, resulting in their conveyance along the axial length of the cylinder toward an end portion thereof extending beyond a side edge of the photoreceptor. By conveying the moved carrier beads out to the end of the cylinder, they then can be removed from the cylinder surface into a container or sump located beyond a side edge of the photoreceptor where space is more readily available. This is in contrast to the prior art approach, where a sump extending from side edge to side edge of the photoreceptor surface is employed to accumulate carrier beads removed from the photoreceptor surface.

The invention accordingly comprises the features of construction, combination of elements, and arrangements of parts, all as detailed hereinafter, and the scope of the invention will be indicated in the claims.

BRIEF DESCRIPTION OF THE DRAWINGS

For a full understanding of the nature and objects of the present invention, reference may be had to the following detailed description, taken in conjunction with the accompanying drawings, in which.

Corresponding reference characters designate like parts throughout the several figures of the drawings.

DETAILED DESCRIPTION OF THE PREFERRED EMBODIMENT

Figure 1:
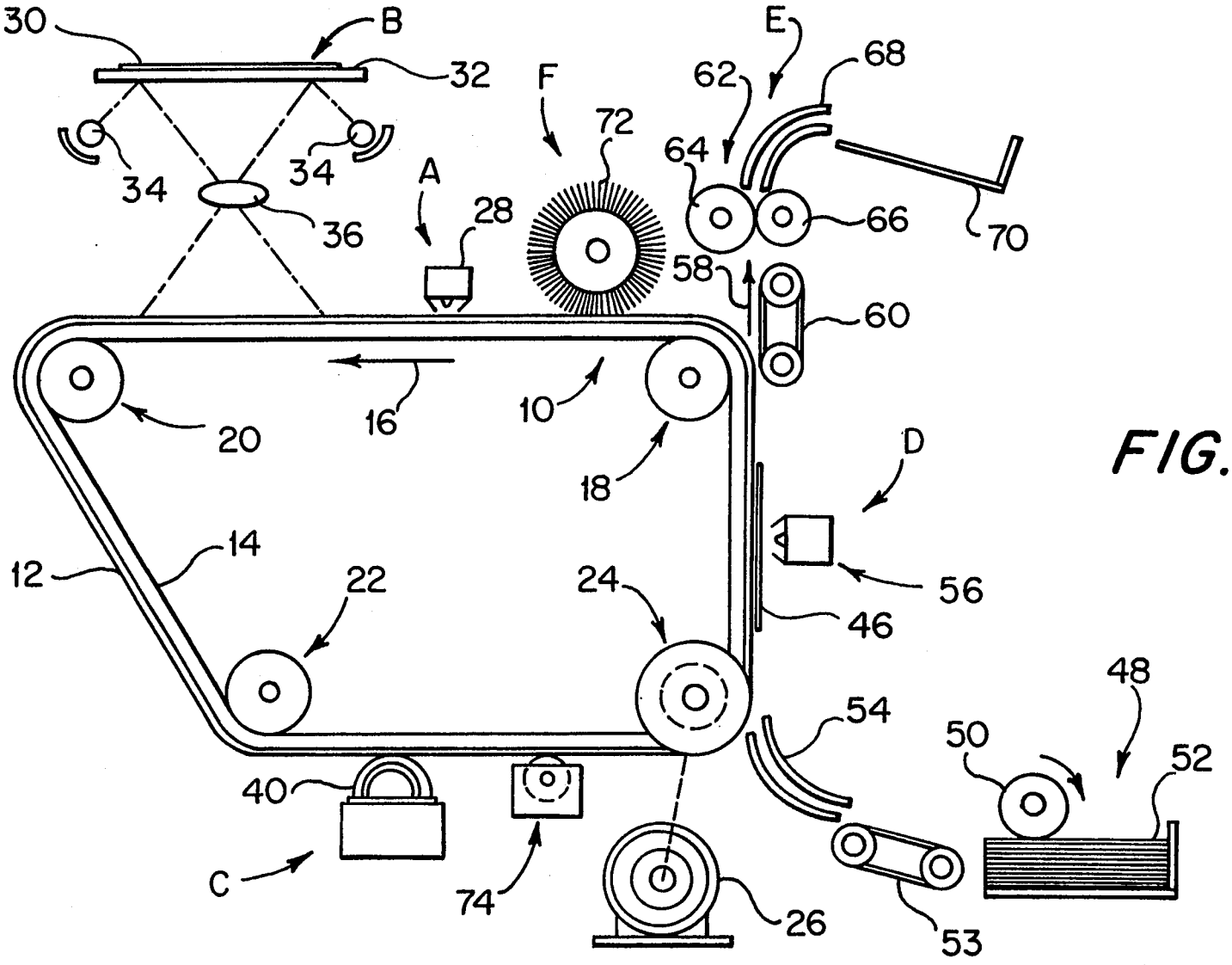
FIG. 1 is a schematic elevational view of an electrophotographic copying machine incorporating the carrier bead pick-off device of the present invention.

FIG. 1 schematically illustrates an electrophotographic copier in which the bead pick-off device of the present invention has particular utility. As shown, the copier includes a photoreceptor in the form of an endless belt 10 having a photoconductive layer 12 deposited on a conductive substrate 14. The photoreceptor belt is trained about rollers 18, 20, 22 and 24, the latter being driven by a motor 26 to advance the belt in a counterclockwise direction indicated by arrow 16. As the belt passes a charging station A, a corona charging device 28 charges the surface of photoconductive layer 12 to a relatively high, uniform potential. The charged photoreceptor then passes through an exposure station B where an original document 30, lying face down on a transparent platen 32, is positioned. This document is illuminated by lamps 34, and a reflected light image of the document is focused on the charged photoconductive layer surface by a lens 36. This light image selectively discharges the surface charge through the substrate to create a latent electrostatic image on the photoconductive layer surface in exact conformity with the document image.

Continued motion of the photoreceptor belt advances the latent electrostatic image to a development station C, where development apparatus including, for example, a magnetic brush 40 operating to bring a two-component developer into contact with the latent electrostatic image. The developer components are coarse carrier beads and fine toner powder, with the toner being held to the bead surfaces by triboelectric attraction. As the developer is brushed over the latent electrostatic image on the surface of the photoconductive layer 12, toner is attracted from the surfaces of the carrier beads to the photoconductive layer surface. The attracted toner thus develops the latent electrostatic image into a conforming powder image. This powder image advances with the photoreceptor belt to a transfer station D where it is transferred to a sheet of copy paper 46 in image formation. Sheet feeding apparatus, generally indicated at 48 includes a feed roll 50 for feeding successive top sheets from a stack 52 onto a conveyer 53 and through a chute 54 into contact with the powder image during its passage through the transfer station. A corona generating device 56 sprays ions on the back surface of the copy sheet 46 to promote transfer of the powder image from the photoreceptor to the front surface of the copy sheet.

The copy sheet, now bearing the powder image, is diverted from the photoreceptor belt and moved in the direction of arrow 58 by conveyor 60 to a fusing station E. This station includes fusing apparatus, generally indicated at 62, acting to permanently affix the powder image to the copy sheet. Typically, the fusing apparatus 62 includes a heated fuser roll 64 and a backup roll 66. As the copy sheet passes through the nip of these rollers, the powder image is fused to permanently affix it to the copy sheet. A chute 68 directs the copy sheets from the fusing station to an output tray where they are accumulated for subsequent removal by the operator. The photoreceptor belt 10 advances to a cleaning station F where a rotating brush 72 removes residual toner from the photoconductive layer surface. The cleaning station may also include a pre-clean corona generator (not shown) acting to neutralize the latent electrostatic image, thus substantially eliminating all toner attraction charges prior to brushing. The belt is now back to charging station A, thus completing a copy cycle.

Figure 2:
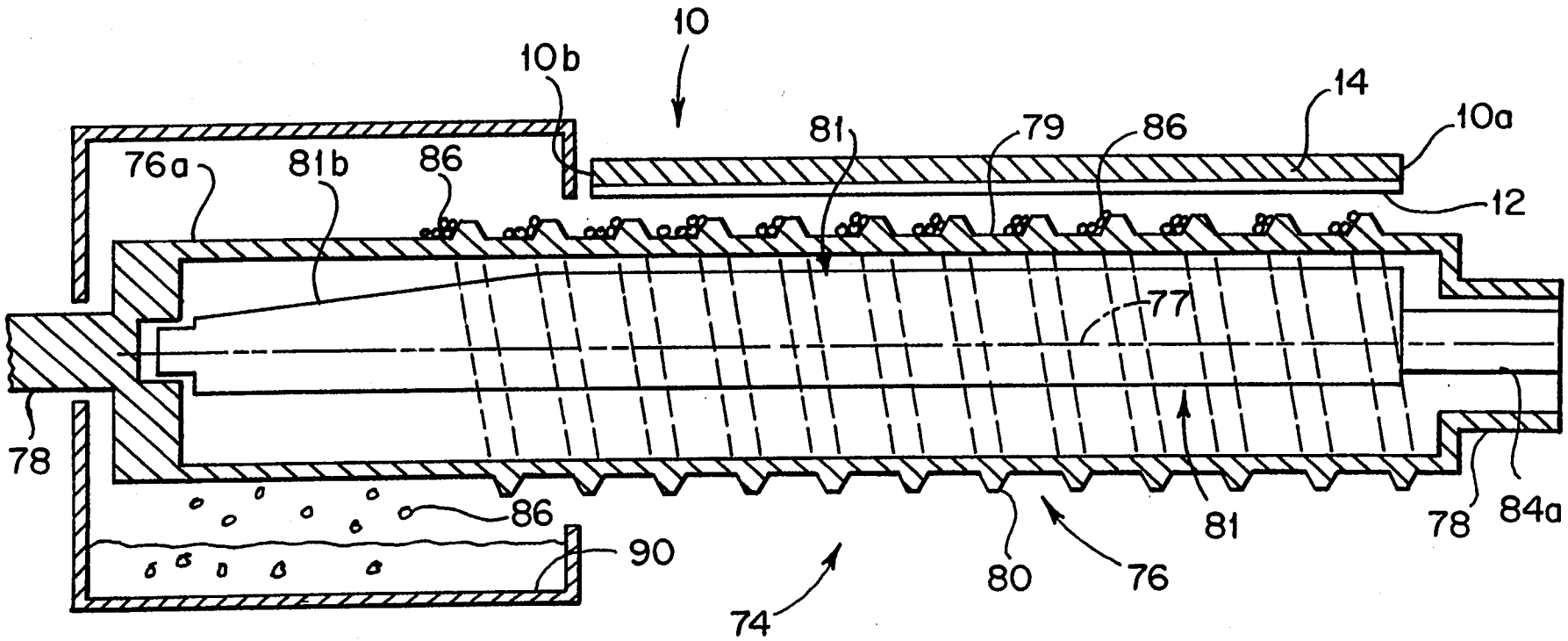
FIG. 2 is an enlarged view, in axial cross section, of the bead pick-off device of the invention.
Figure 3:
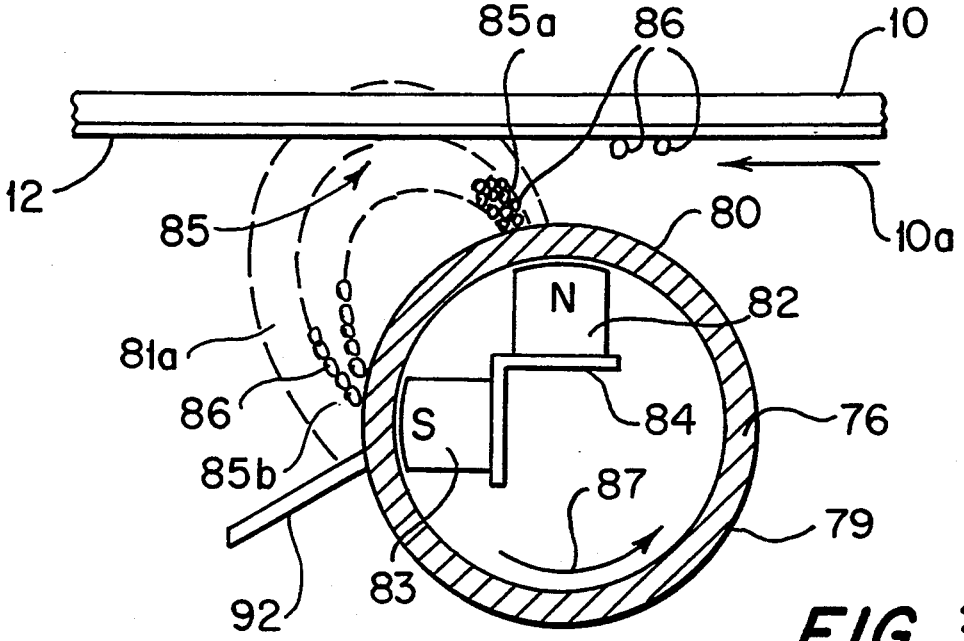
FIG. 3 is a view in radial cross section of the bead pick-off device of FIG. 2.

To remove any carrier beads that may become attracted to and held on the surface of photoconductive layer 12 following creation of the powder image in development station D, a bead pick-off device, constructed in accordance with the present invention and generally designated by the reference number 74 in FIG. 1, is positioned in closely spaced relation to the photoconductive layer surface in a location between the development station and transfer station D. As seen in FIGS. 2 and 3, bead pick-off device 74 includes an elongated cylinder 76 which is formed of a suitable non-ferromagnetic material such as aluminum or stainless steel. This cylinder is positioned in closely spaced relation to the surface of photoconductive layer 12 and is oriented with its axis 77 extending transversely to the direction of motion of photoreceptor belt 10. Stub shafts 78 extending from the ends of cylinder 76 accommodate mounting and rotation by means (not shown). The cylinder is machined to provide a smooth, low-friction exterior surface 79 interrupted by a raised, helical thread 80 extending continuously along at least that portion of the cylinder axial length that is coextensive with the photoreceptor belt width from right side edge **10*a* to left side edge 10*b* in the illustration of FIG. 2**. Rather than machining the cylinder to a smooth exterior surface, the cylinder may be coated with a material to provide a requisite smooth, low-friction exterior cylinder surface.

Positioned within cylinder 76 is an elongated permanent magnet assembly, generally designated by 81, which extends axially through the cylinder interior at least coextensively with the axial length of thread 80. As seen in FIG. 3, the magnet assembly includes a pair of coextensive magnetic pole pieces 82 and 83 mounted in angular relation by an elongated angle bracket 84 having a mounting extension **84*a* extending through the hollow stub shaft 78 (FIG. 2) to a point of attachment to a stationary frame member (not shown). In the embodiment of FIG. 3, pole piece 82 presents a North magnetic pole in proximate relation to the inner surface of cylinder 76 at a position substantially facing photoreceptor belt 10. On the other hand, pole piece 83 presents an opposite or South magnetic pole proximate the inner cylinder surface at a position angularly removed from pole piece 82 in the counterclockwise direction. The angular relationship of these pole pieces is illustrated in FIG. 3 as being essentially 90°. However, in practice, an angular relationship in the range of 30° to 90° can be appropriate, depending largely on the diameter of cylinder 76**.

By virtue of this angular relationship of pole pieces 82 and 83, a stationary magnetic field, indicated by flux lines **81*a*, is developed in a pick-off region 85 between cylinder 76 and the surface of photoconductive layer 12. When the photoreceptor belt, moving in the direction of arrow 10*a* in FIG. 3, brings adherent carrier beads 86 into pick-off region 85, the magnetic field therein produces overpowering magnetic forces effective to attract the ferromagnetic carrier beads from the photoreceptor surface to the cylinder exterior surface at a pick-off location 85***a* proximate pole piece 82. Note that, when cylinder 76 is rotated in the counter clockwise direction, as indicated by arrow 87, cylinder surface 79 and the photoconductive layer surface are moving in generally the same direction through the pick-off region. This relationship facilitates bead pick-off. Since the magnetic lines of force from North pole piece 82 to South pole piece 83 are generally in the direction of the counterclockwise cylinder rotation, the picked off carrier beads are revolved by the cylinder from pickoff location 85*a* around to a conveyance location 85*b* proximate pole piece 83. Since the carrier beads do not accumulate or build up in the pick-off location, disruption of the toner image on the photoconductive layer surface is avoided. The concentrated magnetic field at pole piece 83 causes the carrier beads to slip on the smooth exterior surface 79 of the cylinder, and thus the carrier beads accumulate at this conveyance location, rather than continuing to revolve with the cylinder exterior surface.

Under these conditions, the presence of spiral thread 80 causes the rotating cylinder to function as a material conveying auger, and thus developer beads, whose circumferential motion is halted at conveyance location 85*b*, are conveyed axially by the auger thread leftward to cylinder end portion 76*a* extending beyond side edge 10*b* of the photoreceptor belt. Note that since conveyance location 85*b* is coextensive with the axial length of confronting pole piece 83, there is no need to position a space-consuming sump beneath the cylinder in coextensive relation with the width of the photoreceptor belt to catch carrier beads picked from the photoconductive layer surface.

Having conveyed the carrier beads out to end portion 76*a* of the cylinder, it remains to remove them from the cylinder for accumulation in a sump 90 located entirely beyond the left edge 10*b* of photoreceptor belt 10. One approach to this end is illustrated in FIG. 2, wherein at least the end portion of pole piece 83 extending into sump 90 is tapered down or radially inward, such as indicated at 81*b* in FIG. 2, so as to increase its spacing relative to the conveyance location on the exterior surface of cylinder position 76*a*. As a consequence, the magnetic forces holding the developer beads to the cylinder exterior surface gradually diminish to a level that the beads simply fall by gravity from their conveyance location into the sump. A gradual reduction of the magnetic forces is preferred over a sudden reduction created by abruptly terminating the magnet assembly so as to avoid a concentrated magnetic field at such a termination that would prevent the carrier beads from falling away from the cylinder into the sump. Rather, the carrier beads would build up at the magnet termination to the point that they would resist axial conveyance by auger thread 80. Instead of tapering the magnet to reduce the carrier bead attraction forces in the sump region, a graduated magnetic shielding or shunting approach could be utilized. To assist carrier bead removal from the cylinder end portion, a non-magnetic doctor blade, illustrated at 92 in FIG. 3, may be positioned in sump 90 to wipe against the cylinder exterior surface beyond the termination of auger thread 80. Since provisions are not required to reduce magnetic forces along the length of the cylinder beneath the photoreceptor to allow carrier beads to fall into an underlying sump, such as by significantly increased the spacing between a magnet and the exterior surface of the lower portion of the cylinder, a cylinder of dramatically reduced diameter can be utilized in the present invention.

Figure 4:
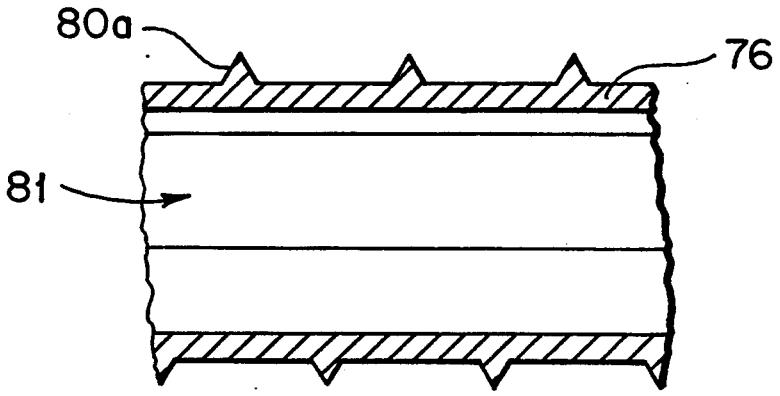
FIG. 4 is a fragmentary sectional view illustrating an alternative auger thread profile from that illustrated in FIG. 2.

Auger thread 80 is preferably quite shallow, from one to several carrier bead diameters in height, to minimize the spacing between the magnet assembly and photoreceptor belt 10 and thus to maximize the magnetic field in the pick-off region, consistent with low-cost spacing tolerances. Rather than trapezoidal in profile, as illustrated in FIG. 2, the auger thread may of a triangular profile, as illustrated at 80*a* in FIG. 4. Preferably the auger thread profile should have a base of a width greater than the width of its peak to minimize the surface area of the thread peak which is most proximate the photoconductive layer surface. This will discourage carrier beads from clinging to the auger thread peak. It will be appreciated that cylinder 76 may also be electrically biased so as to attract non-magnetic debris from the photoreceptor surface. In such case, electric field considerations will also play a part in selecting the optimum height and profile for the auger thread.

Figure 5:
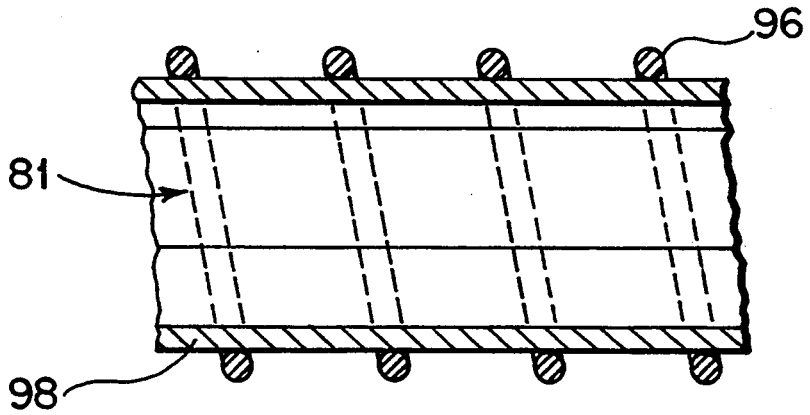
FIG. 5 is a fragmentary cross-sectional view illustrating an alternative approach to forming an auger thread.

Rather than machining the cylinder periphery to from an auger thread, a wire 96 may be spiral wound about the smooth, low friction exterior surface of a cylinder 98, as illustrated in FIG. 5. The coils of the wire are bonded to the cylinder exterior surface to create the auger thread. A 0.075 mm diameter wire wound with a pitch of 1 to 2 mm about a 16 mm diameter cylinder rotating at 60 RPM was found to be effective in conveying carrier beads at an axial velocity in the range of 1 to 2 mm per second.

While the carrier bead pick-off device of the present invention has been illustrated herein in its application to a photoreceptor in the form of an endless belt. It is understood that the invention is equally applicable to a photoreceptor configured as a drum. Moreover, while movements of the photoreceptor and cylinder surface in generally the same direction through the pick-off region are preferred, relative movements in opposite directions are also within the scope of the present invention.

The foregoing description of the present invention has been presented for purposes of illustration and description, and is not intended to be exhaustive or to limit the invention to the precise forms disclosed, and any modifications and variations are possible in light of teachings or may be acquired from practice of the invention. The embodiment is chosen and described in order to explain the principles of the invention and its practical applications to enable one skilled in the art to utilize the invention in various embodiments and with various modification as are suited to the particular use contemplated. It is intended that the scope of the invention be defined by the claims appended hereto, and their equivalents.

What is claimed is:

1. A pick-off device for removing ferromagnetic carrier beads from a surface of a moving photoreceptor during movement between a development station and a transfer station of an electrophotographic machine, said device comprising, in combination:

a rotational, elongated cylinder positioned closely adjacent the photoreceptor surface and oriented transversely to a direction of movement of the photoreceptor surface, said cylinder having a smooth exterior surface;

stationary magnetic means positioned within said cylinder to develop magnetic fields concentrated at a relatively stationary, axially extending pick-off location on said cylinder exterior surface proximate the photoreceptor surface and a relatively stationary, axially extending conveyance location on said cylinder exterior surface circumferentially spaced from said pick-off location in a direction away from the photoreceptor surface, the concentrated magnetic field at said pick-off location attracting carrier beads from the photoreceptor surface to said cylinder exterior surface at said pick-off location; and means on said cylinder exterior surface providing a material conveying auger, whereby, upon rotation of said cylinder, carrier beads magnetically attracted to said pick-off location revolve with said cylinder exterior surface to said conveyance location where the carrier beads accumulate, the accumulated carrier beads slipping on said cylinder exterior surface to promote conveyance of the accumulated carrier beads axially of said cylinder by said auger toward an end portion of said cylinder extending beyond a side edge of the photoreceptor.

2. The pick-off device defined in claim 1, wherein said cylinder exterior surface revolves in a direction generally opposite to a direction of motion of said photoreceptor surface proximate said cylinder exterior surface.

3. The bead pick-off device defined in claim 1, wherein said magnetic means includes a pair of poles of opposite polarity arranged in relative angular orientation in a range of 30° to 60° to provide the concentrated magnetic fields at said pick-off and conveyance locations on said cylinder exterior surface.

4. The pick-off device defined in claim 1, which further includes means located adjacent said end portion of said cylinder to promote removal of carrier beads from said cylinder exterior surface.

5. The pick-off device defined in claim 4, which further includes a sump located adjacent said end portion of said cylinder to accumulate carrier beads removed from said cylinder exterior surface.

6. The pick-off device defined in claim 5, wherein said removal promoting means includes a doctor blade bearing against said exterior surface of said cylinder end portion.

7. The pick-off device defined in claim 1, wherein said auger comprises a spiral auger thread raised from said exterior surface and extending along a length of said cylinder, said exterior surface between said auger thread being smooth to induce slippage of carrier beads thereon during axial conveyance by said auger.

8. The pick-off device defined in claim 7, wherein said auger thread comprises a wire coiled about said cylinder and bonded to said cylinder exterior surface.

9. The pick-off device defined in claim 7, wherein said auger thread is integrally formed on said cylinder exterior surface by machining.

10. The pick-off device defined in claim 9, wherein a profile of said auger thread has a base and a tip, said tip having a narrower width than said base.

11. The pick-off device defined in claim 4, wherein said removal promoting means comprises an end portion of said magnetic means arranged to diminish the magnetic field at said conveyance location, thereby permitting carrier beads to fall from said cylinder exterior surface at said cylinder end portion under the force of gravity.

12. The pick-off device defined in claim 11, wherein said end portion of said magnetic means is tapered radially inwardly away from said exterior surface of said cylinder end portion.

13. The pick-off device defined in claim 1, wherein said magnetic means includes a permanent magnet including first and second axially elongated pole pieces of opposite polarities, said first pole piece axially positioned within said cylinder to establish said pick-off location, and said second pole piece axially positioned within said cylinder to establish said conveyance location.

* * * * *